United States Patent [19]

Fazekas

[11] Patent Number: 4,750,472

[45] Date of Patent: Jun. 14, 1988

[54] CONTROL MEANS AND PROCESS FOR DOMESTIC HOT WATER RE-CIRCULATING SYSTEM

[75] Inventor: Dale J. Frazekas, 9212 Kinlock Dr., Indianapolis, Ind. 46256

[21] Appl. No.: 613,452

[22] Filed: May 24, 1984

[51] Int. Cl.[4] ..... F24H 1/00

[52] U.S. Cl. ..... 126/351; 417/12; 126/36 Z; 237/8 A

[58] Field of Search ..... 126/351, 374, 361, 362; 236/9 A, 46 A, 46 R, 37; 122/448; 417/12; 237/8 A, 8 R; 219/323, 334, 492

[56] References Cited

U.S. PATENT DOCUMENTS

| | | | |
|---|---|---|---|
| 1,780,379 | 11/1930 | Durow et al. | 126/351 X |
| 4,142,515 | 3/1979 | Skaats | 417/12 X |
| 4,201,518 | 5/1980 | Stevenson | 417/12 |
| 4,298,165 | 11/1981 | McKinley | 417/12 X |
| 4,420,677 | 12/1983 | Partington | 237/8 A X |

*Primary Examiner*—Randall L. Green

*Attorney, Agent, or Firm*—Robert A. Spray

[57] ABSTRACT

A control means and process for a recirculating hot water system having a hot water supply pipe and a hot water return pipe connected in a loop between a hot water outlet of a hot water tank and a return inlet to that tank, and having an electrically controlled recirculating pump in the loop, for keeping sufficient circulation in the loop as to assure substantially instant dispensing of water of a desirably high temperature. The control governs the operability of the recirculating pump, causing it to operate for a pre-established time period as determined by the amount of time required to bring the supply pipe portion of the recirculation loop up to desired maximum operating temperature. After the supply pipe portion of the recirculation loop is brought up to the desired maximum operating temperature, the control switches off the recirculating pump for a pre-established time period determined by the heat-holding capability of the supply side of the recirculating loop, and the minimum desired operating temperature of the supply portion of the recirculating loop.

1 Claim, 2 Drawing Sheets

CONTROL MEANS AND PROCESS FOR DOMESTIC HOT WATER RE-CIRCULATING SYSTEM

I. BACKGROUND OF THE INVENTION

Figure 1:
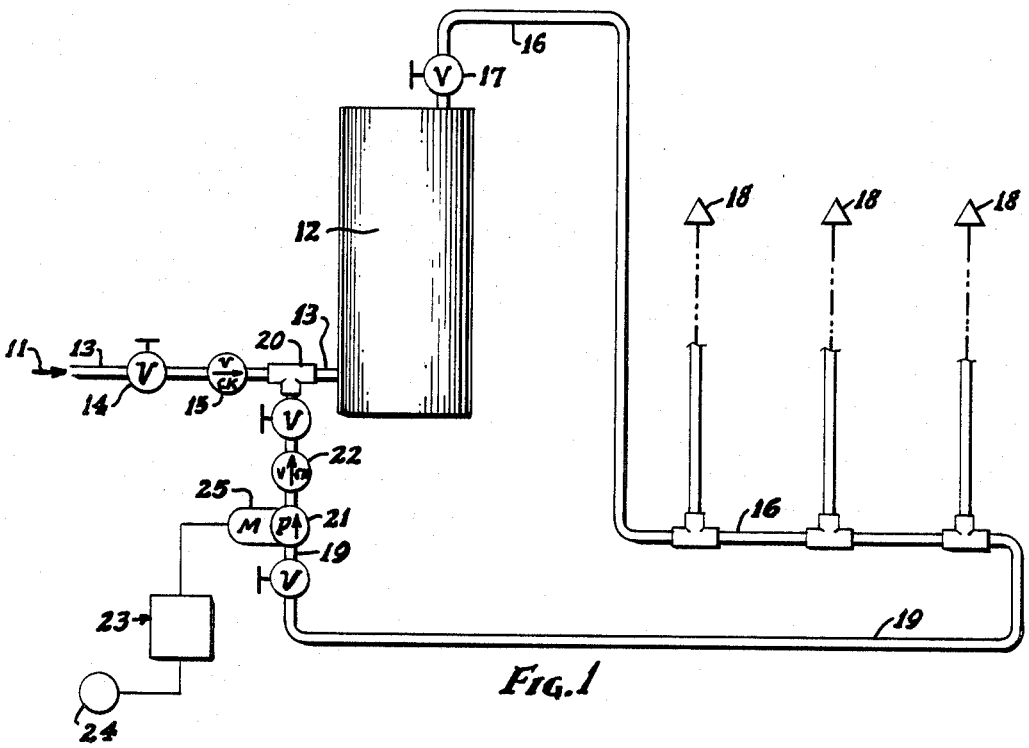

The present invention relates to hot water systems, and more particularly to hot water systems of a so-called "recirculating" type intended to provide "instant" hot water throughout a building, i.e., providing water at a high temperature at the service outlets substantially instantly as the water emerges from any service outlet, regardless of how far the particular service outlet is from the water heater, and regardless of the tendency of the hot water service line to be cooled by the cooler temperature of the ambient air through which the service line passes.

The hot water system as herein involved is commonly referred to as a "domestic system", i.e., a system which provides hot water for use as such, such as for washing, etc., in contrast to heating purposes; and it is called "domestic" in that sense, even though it is likely more for commercial buildings than for private residences.

Hot water systems of recirculating type are most frequently used in buildings of large size or in which the length of pipe used for hot water supply creates an undesirable length of time for delivery of hot water from where it is stored to the various service outlets throughout the building.

Such a system consists of a hot water supply pipe, from which hot water is supplied from the hot water tank to the service outlets, and a return pipe, which connects the last point of the supply pipe back to the hot water tank, creating a continuous loop of pipe through which water unused from any service outlet may flow back to the storage tank. There is often included a recirculating pump, in the return pipe, to promote flow in the desired direction toward the tank; and a check valve is installed in the return pipe, usually somewhere near the pump, to stop the water from flowing in an undesired direction.

The pump of such a system is operated to circulate the hot water from the storage tank through the supply pipe, and back to the storage tank via the return pipe; and the result is that the supply pipe is kept constantly at maximum operating temperature providing instantaneous hot water to the service outlets along the supply pipe.

Such systems of the prior art desirably nearly eliminate the time required for delivery of hot water from the hot water storage tank to the service outlets, and greatly reduce the amount and the heat content of water wasted by the user running water from the hot water service outlets until the water becomes usably hot, as would be the situation in a system where there is no circulation to keep water hot at all service outlets.

However, a disadvantage of recirculating hot water systems of the prior art is a substantial waste of energy in the form of heat loss from the water throughout the system during circulation. The circulated water that returns to the storage tank must be accordingly reheated back to the desired operating temperature. This condition constantly exists as long as the water is circulated, usually 24 hours a day.

Another disadvantage of prior art systems of continuous circulation is that in warm weather operation; for as the circulated water is losing heat into the building, the air conditioner load of the building correspondingly increases so as to remove from the building the heat dissipated into it by the hot water circulating system. This condition is not fully offset by a converse advantage during winter months, because of a lack of efficiency for heat transfer usefully into the building; i.e., that dissipated heat from the circulating hot water loop is usually located in floors, walls, or other areaways which do not achieve efficient heating of the building.

Another system available in the prior art is a system that incorporates a heat sensing thermostat that will disable the circulating pump when the temperature of the water at the thermostat reaches a desired level. The disadvantage of this system is that the heat-sensing thermostat is usually installed in the return pipe, very near the circulation pump, which itself is installed at the downstream end of the return pipe near the hot water tank.

In this prior art arrangement or configuration, the entire system is being regulated by the temperature which exists at the end of the return pipe; and this results in the entire circulation loop still being maintained at a fairly high temperature level, but this is wasteful of energy due to the keeping of the return line hot even though the return line is a long portion of the overall circulation loop, and the temperature of the return line water is of no significance to the temperature of the water in the supply pipe portion which contains the service outlets.

The above disadvantage could theoretically be minimized by installing the thermostat at the end of the supply pipe; however, that location is usually so remote and far away from the circulating pump, that the factors of installation of wiring of that tremendous length, together with the usual relative inaccessibility of that remote location, having meant that such an installation of the thermostat at that remote location seems not to have been considered as a practical solution.

Even an attempt to locate service outlets along the entire loop, to minimize the length of what would be just a short return line portion with no service outlets, is also not effective in this regard, because it would increase the overall length of pipe which would be required to be at the desired operating temperature of a service outlet use.

Thus in contrast to the prior art recirculating systems, the present inventive concepts provide a controlled recirculating domestic hot water system which has the advantages of nearly instantaneous hot water availability at all service outlets, yet which is more conservative of energy consumption than are previous recirculating hot water systems.

An additional achievement of the present invention is the provision of a recirculating hot water system control which is easy to install, is adjustable by the user to meet various installation conditions, and which is fully automatic in its operation.

II. SUMMARY OF THE INVENTION AND ITS CONCEPTS

The overall achievement of the present invention is the reduction in the amount of wasted energy in a domestic hot water circulating system created by continuous circulation of hot water in piping located throughout a building, but nevertheless providing instantaneous hot water at all service outlets of the system. There is provided a fully automatic control for domestic hot water systems utilizing the heat-holding capability of the hot water supply pipe, and the system uses a circulation pump only to maintain a pre-established temperature range of the hot water supply pipe.

More particularly, the wasted energy is reduced by utilizing the hot water supply pipe's heat-holding capabilities on a time control basis, and by establishing a minimum and maximum desired operating temperature of the supply pipe and calculating the amount of time for a given type and size of pipe to dissipate enough heat to drop from maximum desired operating temperature to minimum desired operating temperature. This is the extensive period of no recirculation, resulting in significant energy savings.

After each such time period has elapsed, the circulation pump comes back on only for a time period great enough to completely fill only the supply pipe with water at the maximum desired operating temperature. Once the supply pipe has been refilled with hot water at the maximum desired operating temperature, the circulation pump will automatically shut off; and the pre-established time period of supply pipe cool-down will automatically begin again.

The operation is automatically cylical; i.e., one complete cycle includes one time period during which the circulation pump runs, bringing the supply line up to full operating temperature, and a subsequent period when the circulating pump is not running, while the water in the supply pipe is cooling from the maximum desired operating temperature to the minimum desired operating temperature.

The present invention can be modified to include an over-ride circuit to de-energize the timing cycles completely for an extended period of times, i.e., week-ends, etc. This over-ride could consist of a mechanical/electrical device or totally solid state.

The above is of introductory and somewhat generalized nature. More particular details, features, and concepts are set forth in the following more detailed description, taken in conjunction with the accompanying drawings.

In such drawings, which are somewhat diagrammatic or schematic for illustrating the inventive concepts:

FIG. 1 is a piping schematic diagram of a typical recirculating hot water system having installed therein a control means of the present invention, providing a temperature-control of the supply pipe by means of responsiveness to (a) the time of pump-running required to replenish the supply line with water heated by the heater, and responsiveness (b) to the length of time at which the supply line will cool from its maximum temperature to its minimum temperature.

Figure 2:
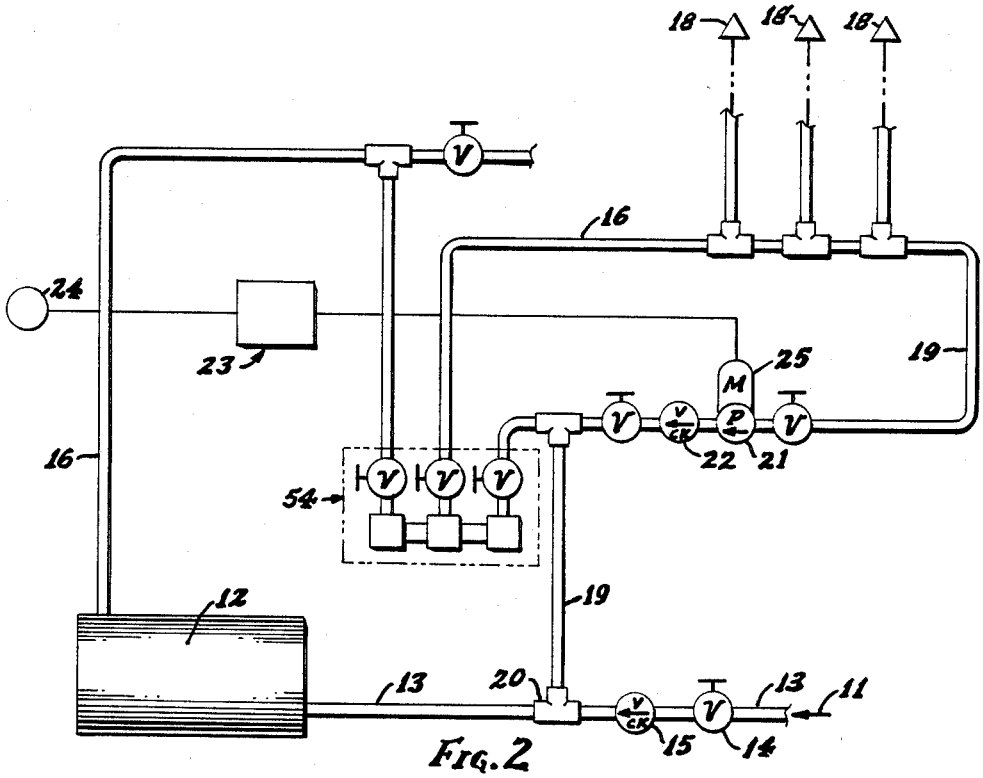
Figure 3:
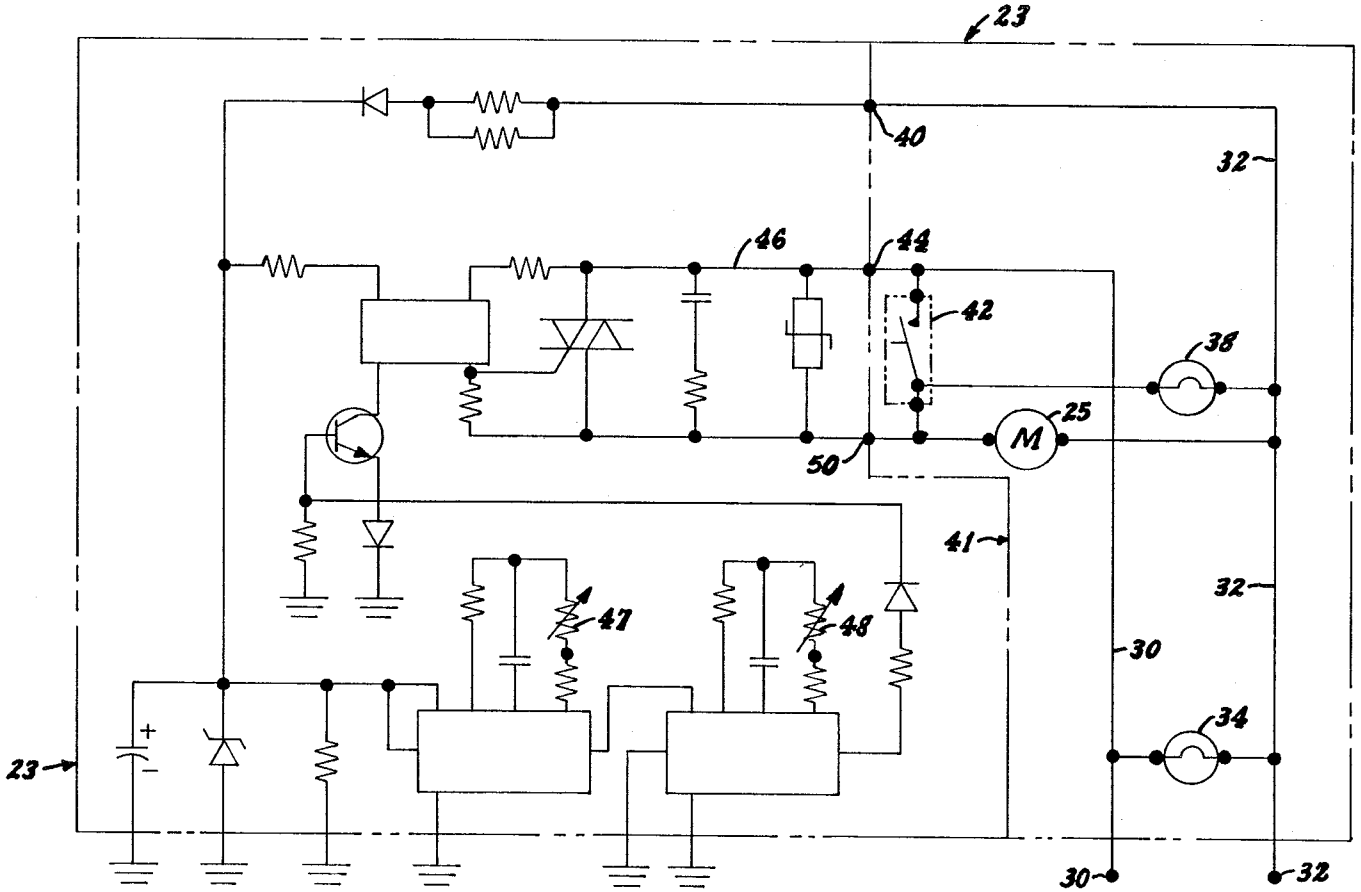

FIG. 2 is a piping schematic diagram similar to FIG. 1, utilizing the control means of the present invention, but in a system which includes a "3-way" mixing valve; and FIG. 3 is a schematic diagram of the control unit of the system and process shown in FIGS. 1 and 2, for providing the timing and sequential nature of activation of the re-circulating pump of the system.

III. DETAILED DESCRIPTION OF THE PREFERRED EMBODIMENT

As shown in the diagrammatic layout of FIG. 1 of the drawing, there is shown a piping schematic of a "domestic" typical recirculating hot-water system which is used for a motel, multi-unit apartment building, retirement home, resident hall, and other types of commercial buildings that require instantaneously hot water at the various service outlets. Ambient temperature water 11 is supplyed to the hot water heater or storage tank 12 from an external source, as shown by the flow of ambient water through the inlet pipe 13 through an isolation valve 14 and check valve 15 to the heater or tank 12.

The water is heated to a desired temperature, and leave the tank 12 through a supply pipe 16 which may also include an isolator valve 17; and the hot water travels through the supply pipe 16 to the hot water service outlets 18 (faucets, shower heads, etc.), and continues back via the return pipe 19 and is connected by a tee 20 to the inlet pipe 13 upstream of the tank 12.

An electric motor-driven centrifugal pump 21 is used in the return pipe 19 to provide circulation, providing that hot water is always at the faucets or hot water service outlets 18. A check valve 22 is installed in the hot water return pipe 19 to prevent back flow. The piping arrangement is a continuous loop with the hot water service outlets 18 located at convenient points as desired.

According to concepts of the invention, a control device 23 is shown wired in series between the electrical power source 24 and motor 25 of the pump 21. (The control 23 can be incorporated as part of the junction box power source 24 or as a part of the pump motor 25, or a separate item.)

As shown in the diagrammatic layout of FIG. 3, there is shown an electrical schematic of the control means 23 of the present invention, to be used to control the electrically-driven motor 25 of the circulation pump 21. A 110 volt AC power supply current is supplied to line connections 30 and 32 of the control means 23. Power indicator light 34, across those lines 30 and 32, indicates that connection.

Power line 32 continues as a common power source to circulating pump motor 25, its energization being shown by pump run indicator light 38 in parallel with the pump motor 25, and to the input terminal 40 of the cycle timer 41.

Power line 30 continues to a mechanically actuatable (or over-ride) switch 42 that may be used to by-pass the cycling portion of the present invention, and also continues to the input power connection 44 of cycle timer 41.

Line power continues from connection 44 through the cycle timer circuit 46; and its timing periods are adjustable by an adjustable resistor 47 for adjusting the time period of no power supply to pump motor 25 and by adjustable resistor 48 used for adjusting the time period which the pump motor 25 runs via power supplied to outlet connection 50 of timer 41.

Specific portions of the repeat cycle timer 41 are shown representatively as those of an Artisan Electronics Corp. Model No. 4610 A 65A; such a timer as represented by the components is well known to a person skilled in the art, and thus is shown here merely schematically. No inventiveness claim is here asserted to this or any other timer, this invention being usable with any type of timing means which provides cyclically and sequentially a time-controlled energization period for the pump motor 25 followed by a time-controlled de-energization period for that motor 25.

In FIG. 2, the layout is different from the FIG. 1 layout in that a 3-way mixing valve 54 is included.

To illustrate the saving of heat energy, it seems convenient first to consider the total energy requirement of a domestic hot water recirculation system. The total cost includes both the cost of heating the water that is dispensed at the hot water outlets, and the cost of heating the water that is reheated as an incident to its heat loss during its recirculation. The following overall calculations are shown for a system which may be considered typical:

1. The cost of heated water dispensed through the service outlets is calculated by the standard formula:

Gallons of water per minute × the temperature(Ref.1) rise in °F. × 500 (a Water Constant Coefficient equals the BTU per hour requirement.

As an example: Assume the average load is 10 gallons per minute, the incoming water temperature is 65°, and 130° F. hot water is desired.

$$10\ GPM \times 65°\ F. \times 500 = 325{,}000\ BTU/hr$$

2. The cost of reheating the hot water which is recirculating is the function of the amount of BTU/hr. required to reheat the water that is returned to the heater. As the hot water flows through the pipe loop, heat is lost through radiation.

As an example: Assume the temperature of water leaving the heater is 130° F., the returning temperature is 115° F., and the pumping volume is 4 GPM.

$$4\ GPM \times 15°\ F. \times 500 = 30{,}000\ BTU/hr$$

3. To calculate the total actual water-heating cost, assume the system uses an electric water heater, and the KWH (Kilowatt Hour) rate is $0.07.

3A. COST OF HOT WATER USED (1) 325,000 BTU/HR. ÷ 3413(Ref.2) = 95.22 KWH (2) 95.22 KWH × $0.07 = $6.66 per hour (3) $6.66/hr × 8760 hours/year = $58,341.60

3B. COST OF RECIRCULATED WATER (1) 30,000 BTU/HR ÷ 3413 = 8.79 KWH (2) 8.79 KWH × $0.07 = $0.615 per hour (3) $0.615/hr × 8760 hours/year = $5,387.40

TOTAL COST: $58,341.60 + $5,387.40 = $63,729.00

The principle of operation of the invention is to utilize the supply pipe 16 as a heat sink, and maintain an acceptable minimum and maximum hot water temperature of the water, which is desired to be available at the hot water outlets. Usually, the temperature that is desirable in a domestic hot water system is 110° to 130° F. Therefore, it seems desirable to explain the relationship of the ability of the supply pipe 16 to retain heat, and the amount of time that the system does not require recirculation.

4. Calculations showing the supply pipe's ability to retain heat, and the time required for temperature changes:

Assumptions in the following calculations:

1. No insulation.

2. No effects of conductivity from supply tank touching the supply pipe.

3. The outer wall temperature of the pipe is the same as the water temperature, since the conductivity of copper is so high.

4A. HEAT BALANCE:

Heat input = Heat output $$(Cp_w\ Ww + Cp_c\ Wc)\frac{\Delta t_w}{\Delta T} = h_o\ A_o\ (t_w - t_a)$$

-continued $$\Delta t_w = \left(\frac{h_o\ A_o}{Cp_w\ W_w + Cp_c\ Wc}\right)(t_w - t_a)(\Delta T).$$

Substituting by use of factor $\overline{K}$:

$$\Delta t_w = \overline{K}(t_w - t_a)\cdot\Delta T$$

Where:

$\Delta t_w$ = Temperature difference of water in °F.

$\Delta T$ = Unit of time for each temperature in hours $h_o$ = Heat transfer coefficient in BTU/Hr. Ft.$^2$ °F.(Ref.5) (Convection and Radiation)

$A_o$ = Outside surface area of pipes, in Ft.$^2$ per linear Ft.(Ref. 6)

$Cp_w$ = 1.0 BTU/Hour °F., specific heat of water(Ref. 3)

$Cp_c$ = 0.092 BTU/Hour °F., specific heat of copper(Ref. 4)

$W_w$ = Weight of water, in pounds per linear foot of pipe(Ref. 10)

$W_c$ = Weight of copper, in pounds per linear foot of pipe(Ref. 6)

$t_w$ = Temperature of water $t_a$ = Temperature of surrounding air $$K = \frac{h_o\ A_o}{Cp_w\ W_w + Cp_c\ W_c}$$

4B. Calculation to determine "$h_o$", as convection and radiation, "$h_o$" being the total heat loss:

The calculation No. 4A shows the value for $h_o$ (symbols defined below) as a function of the temperature difference between the outer tube surface and the surrounding air, and the outside diameter of the outside surface of the tube. The data was taken from Ref. 5. As stated, since the emissivity of oxidized steel is high, and the $h_r$ for radiation represents only a part of the total $h_o$ (radiation and convection), the values for $h_o$ shown can be used for non-metallic surfaces also.

$$h_c = 0.27\left(\frac{\Delta t}{D_o}\right)^{0.25} \quad \text{(Ref. 9)}$$

$$h_r = EQ(t_o^2 + t_a^2)(t_o + t_a) \text{(Ref. 8)}$$

$$h_o = h_c + h_r$$

Where:

$\Delta t$ = Temperature difference between outer tube surface and surrounding air.

$D_o$ = Outer surface diameter in feet.(Ref. 6)

E = Emissivity of surface (0.8 for oxidized copper)-(Ref. 8)

Q = Stefan-Boltzmann constant 0.174($10^{-8}$)BTU/Hr. Ft.$^2$ °F.$^4$ (Ref. 7)

$t_o$ = Outer surface Temp. in °R.

$t_a$ = Air temperature in °R.

$h_c$ = Convection heat loss $h_r$ = Radiation heat loss

°R = 460 + °F. (Rankine)

EMISSIVITY ASSUMPTION (E)

The following analyses assume that the Emissivity, E, for the copper pipe and insulation is 0.8. This assumption is valid for oxidized copper and dull surface insulation, and will result in the highest heat transfer rate through the pipe and insulation and hence the quickest time for water chill-down. If the bare copper were polished and the outside surface of the insulation were shiny, the Emissivity E would be greatly reduced and the heat transfer rate would decrease and approach the rate for convection only, i.e., $h_r \rightarrow O$. This would result in longer times for water chill-down.

4C. Determination of $h_o$

1. For bare copper pipe, oxidized surface, outer surface temperature ranges from 150° F. to 90° F. ($t_{air}$=70° F.)

2. Therefore, Δt of surface to air ranges from 80° F. to 20° F.

3. Calculation 4A for $h_o$ is good to a Δt down to 50° F. If one were to average the $h_o$ between a Δt=80° F. and a Δt=20° F. for the various pipe diameters, one would find that this average value is about 5% less than the $h_o$ shown for the experimental data at 50° F. Δt, because the average Δt of the tube surface is 50° F.

CHART I

| Nominal Diameter (In.) | Values for $\bar{K}$ Bare Pipe Outside Diameter (In.) | $h_o$ | $\bar{K}$ |
|---|---|---|---|
| 1 | 1.125 | 2.30 | 1.62 |
| 1¼ | 1.375 | 2.25 | 1.29 |
| 1½ | 1.625 | 2.20 | 1.07 |
| 2 | 2.125 | 2.15 | 0.80 |
| 2½ | 2.625 | 2.10 | 0.63 |
| 3 | 3.125 | 2.05 | 0.51 |
| 4 | 4.125 | 2.00 | 0.38 |

$$\bar{K} = \frac{0.262\, h_o D_o}{Cp_w W_w + Cp_c W_w}$$

5. Determination of $h_o$, considering insulation:

Assumptions:

1. Copper pipe wrapped with insulation
2. No effects of conductivity from supply tank touching the supply pipe
3. The outer copper wall temperature is the same as the water temperature since the conductivity of copper is so high
4. Neglect weight of insulation Heat Balance:

Since the heat flow through the pipe is the same as that through the insulation, and the same as that from the insulation to the air, the following results;

$$(Cp_w W_w + Cp_c W_c)\frac{\Delta t_w}{\Delta T} = \frac{2\pi k(t_1 - t_2)}{\ln \frac{r_2}{r_1}}. \quad 5A$$

$$\frac{2\pi k(t_1 - t_2)}{\ln \frac{r_2}{r_1}} = h_o A_o (t_2 - t_a). \quad 5B$$

Where $h_o$ is the combined heat loss of convection and radiation ($h_c$+$h_r$), and $\Delta t_w$=Temperature difference of water, degrees F.

ΔT=Unit of time for each temperature difference, hours $h_o$=Heat transfer coefficient, BTU/hour Ft² °F.

$A_o$=Outside surface area, Ft.² per linear Ft.

$Cp_w$=1.0 BTU/Hour °F.(Ref. 3)

$Cp_c$=0.092 BTU/Hour °F.(Ref. 4)

$W_w$=Weight of water, Lbs. per linear Ft.

$W_c$=Weight of copper, Lbs. per Linear Ft.

k=Insulation conductivity, BTU per Hour Ft.² °F.

$r_1$=Radius of inner wall of insulation, in.

$r_2$=Radius of outer wall of insulation, in.

$t_1$=Temperature of the pipe, °F.

$t_2$=Temperature of the outside surface of the insulation, °F.

Solving Equation 5B for $t_2$ yields:

$$t_2 = \frac{2\pi k\, t_w + h_o A_o \ln r_2/r_1 \cdot t_a}{h_o A_o \ln r_2/r_1 + 2\pi k}$$

Now substitute this $t_2$ into equation 5A, in order to obtain an equation with only the known temperatures $t_w$ and $t_a$; the result is:

$$\Delta t_w = \frac{2\pi k\, h_o A_o (t_w - t_a) \cdot \Delta T}{(h_o A_o \ln r_2/r_1 + 2\pi k)(Cp_w W_w + Cp_c W_c)}$$

$$\Delta t_w = K (t_w - t_a) \cdot \Delta T$$

$$K = \frac{2\pi k\, h_o A_o}{(h_o A_o \ln r_2/r_1 + 2\pi k)(Cp_w W_w + Cp_c W_c)}$$

This equation is identical in form with that for the Bare Tube; the $\bar{K}$ coefficient is different and takes into account the effect of the insulation (k, $r_1$, and $r_2$).

5C. Determining $h_o$ for insulated pipe (first iteration)

Since the data in Calculation 4 is valid for a Δt down to 50° F., and since the surface temperature of the insulation will be such that the Δt will be less than 5° F., the following approximation method was used in determining an average $h_o$:

1. Assume $h_o$=1.5
2. Solve for $t_2$ when water temperature=150° F.
3. With $t_2$ and $t_a$, determine $h_c$ and $h_r$ and thus $h_o$
4. Re-calculate $t_2$ with new $h_o$
5. Repeat Step 3; one iteration should suffice.
6. Repeat above steps for water temperature=90° F.
7. For a given $D_o$, use average $h_o$ from Steps 5 and 6.

Example: Using data for 2½" nominal pipe, ½" insulation.

$$E = 0.8 \quad \Delta t = 18.2° \text{ F.} \quad k = 0.0217$$

$$t_2 = \frac{20.4 + 32.2}{0.46 + .136} = 88.2° \text{ F.}$$

$$h_c = 0.503\left(\frac{18.2}{3.625}\right)^{0.25} = 0.75 \quad \text{(Ref. 9)}$$

$$h_r = 0.174(10^{-8})(0.8)[548^2 + 530^2][548 + 530] = 0.87$$

$$h_o = 0.75 + 0.87 = 1.62$$

5D Second iteration

New $t_2$ = 87.3° F.

$h_c$ = 0.74

$h_r$ = 0.87

$h_o$ = 1.61

Therefore:

$h_o$ for $t$ = 150° F. is 1.61

$h_o$ for $t$ = 90° F. is 1.40

-continued $$h_{oAve.} = \frac{1.61 + 1.40}{2} = 1.50$$

CHART II

| Values of $\overline{K}$ ½" of insulation | | | |
|---|---|---|---|
| Nominal Diameter | Outside Diameter | $h_o$ | $\overline{K}$ |
| 1" | 2.125" | 1.5 | 0.408 |
| 1¼" | 2.375" | 1.5 | 0.315 |
| 1½" | 2.625" | 1.5 | 0.254 |
| 2" | 3.125" | 1.5 | 0.183 |
| 2½" | 3.625" | 1.5 | 0.142 |
| 3" | 4.125" | 1.5 | 0.116 |
| 4" | 5.125" | 1.5 | 0.084 |

$$\Delta t = \overline{K}\Delta T(t\text{-}70)$$

$$\overline{K} = \frac{2\pi k h_o A_o}{(h_o A_o \ln \frac{D_o}{D_1} + 2\pi k)(Cp_w W_w + Cp_c W_c)}$$

The $h_o$ varied from 1.54→1.47 when $D_o$ varied from 2.125→5.125 inches. Therefore, use $h_o = 1.5$ for all tube diameters. It should be noted that the value of $\overline{K}$ and hence the time for water chill-down varies by about only 6% (faster chill down) when the $h_o$ varies from 1.5 to 2.0.

6. RESULTS (from Calculations 4 and 5);

CHART III

| Temperature Increment | Water Temp. °F. |
|---|---|
| t = 0 | 150.0 |
| 1 | 142.9 |
| 2 | 136.4 |
| 3 | 130.5 |
| 4 | 125.1 |
| 5 | 120.2 |
| 6 | 115.7 |
| 7 | 111.6 |
| 8 | 107.9 |
| 9 | 104.5 |
| 10 | 101.4 |
| 11 | 98.6 |
| 12 | 96.1 |
| 13 | 93.8 |
| 14 | 91.7 |
| 15 | 89.8 |

CHART IV

| Time between each temperature increment for various pipe diameters (in minutes) | | |
|---|---|---|
| Nominal Pipe Diameter (inches) Type L Copper | (From Calc. 4) Bare Pipe ΔT minutes | (From Calc. 5) ½" Insulation ΔT minutes |
| 1" | 3.3 | 13.1 |
| 1¼" | 4.1 | 17.0 |
| 1½" | 5.0 | 21.1 |

CHART IV-continued

| Time between each temperature increment for various pipe diameters (in minutes) | | |
|---|---|---|
| Nominal Pipe Diameter (inches) Type L Copper | (From Calc. 4) Bare Pipe ΔT minutes | (From Calc. 5) ½" Insulation ΔT minutes |
| 2" | 6.7 | 29.2 |
| 2½" | 8.5 | 37.7 |
| 3" | 10.5 | 46.1 |
| 4" | 14.1 | 63.7 |

ΔT = Time increment between each temperature increment $t_0$, $t_1$, $t_2$, etc., for given pipe size.

The above results demonstrate the ability of the supply pipe to retain heat, and show the amount of time the recirculating pump 21 can be shut off without effecting the instantaneous supply of hot water available at the hot water service outlets 18.

For example, to determine how long it would take 1κ" bare pipe to cool from 130.5 to 111.6, look in Chart III, and observe that such temperature difference would be 4 "temperature increments". Then multiply that number 4 by the appropriate value from Chart IV, i.e., the number 5.0, resulting in an answer of 20 minutes.

CHART V

| Type "L" Copper Pipe Data (Ref. 6) | | | | | | |
|---|---|---|---|---|---|---|
| Nominal Diameter (Inches) | Outside Diameter Bare Pipe (Inches) | $A_0$ Bare Pipe Ft²/lin. ft. | $A_0$ ½" Insulation Ft²/lin. ft. | $W_w$ lbs/lin. ft. | $W_c$ lbs/lin. ft. | Outside Diameter ½" Insulation (Inches) |
| 1 | 1.125 | 0.295 | 0.556 | 0.358 | 0.655 | 2.125 |
| 1¼ | 1.375 | 0.360 | 0.622 | 0.545 | 0.884 | 2.375 |
| 1½ | 1.625 | 0.425 | 0.687 | 0.771 | 1.14 | 2.625 |
| 2 | 2.125 | 0.556 | 0.818 | 1.34 | 1.75 | 3.125 |
| 2½ | 2.625 | 0.687 | 0.949 | 2.07 | 2.48 | 3.625 |
| 3 | 3.125 | 0.818 | 1.08 | 2.95 | 3.33 | 4.125 |
| 4 | 4.125 | 1.08 | 1.34 | 5.19 | 5.38 | 5.125 |

7. Calculating the length of time circulation is necessary (time of pump running):

The second aspect of the invention is to control the amount of time required to increase the supply pipe 16 temperature from 110° to 130° F.

Assume the size of the return pipe 19 to be 1" copper, type L, 100 ft. long. The circulating pump 21 will pump at a rate dependent on the size and length of the return pipe 19 and the diameter of the pump 21 impeller. The size and length of the return pipe 19 is dominant in determining pressure drop because of its smaller size in relation to the supply pipe 16. Centrifical pump performance (and horse power) is dependent on impeller diameter. Therefore, flow rate (in gallons per minute) will be at the intersection point of the performance curve of the pump and the system pressure drop curve.

Assume the pumping rate is 11.5 GPM; 100 ft. of 1½" Type L copper pipe (supply pipe 16) contains 0.25 gal. per lineal foot(Ref. 6), ×100 ft.=25.0 gal. Pump time thus equals 25/11.5=2.17 min.

If the GPM rate of the pump 21 is increased, the time required to arrive at the desired temperature in the supply pipe 16 is reduced. This results in the same amount of BTU/hr equipment to reheat the recirculated water. As an example: The maximum desired temperature at the last hot water outlet 18 in the supply line 16 is 130°. At a pumping rate of 11.5 GPM, it takes 2.17 minutes to pump the hot water to the last outlet 18 and achieve a 130° F. temperature. The recirculation cost (energy required to reheat the water) is 11.5 GPM$\times$(130° $-t_3$)$\times$500, $t_3$ being the temperature of the return section of the continuous loop. Let us assume $t_3$ is 100° F., the BTU/hr is 11.5$\times$30$\times$500=172,500. As the pump ran for 2.12 minutes, the actual load is 172,500 BTU/hr$\times$0.037 hrs=6382 BTU/hr. Now, assume we reduce the pumping rate to 5.75 GPM; the required time to arrive at 130° at the last outlet will, theoretically, double to 4.34 minutes. Therefore, the BTU/hr energy requirement will be the same: 5.75$\times$30$\times$500=86,250 BTU/hr. That, times 0.074 hrs.=6382 BTU/hr.

Although it is possible to calculate the time required to pump the supply 16 to the maximum desired temperature and the time required to arrive at the minimum acceptable temperature, it is more practical to record the hot water temperatures at the last service outlet 18. The "pump on" time can be set by this method very easily.

The calculated time required for the supply pipe 16 temperature drop is not an accurate method of determining this time, as tests show that there is a radiant heat transfer effect from the hot water heater/storage tank 12 through the supply pipe 16. This effect reduces the time required to pump the supply pipe 16 up to the desired maximum temperature and increases the time required for the drop in supply pipe 16 temperature. The result of the radiant effect is reduced recirculation time and a further reduction of heat energy.

The invention can be retrofitted to any existing recirculating system by simple installation of wiring the invention in series between the pump motor 21 and the electrical power source 24. As both the pulse (pump run time) and the pause (pump off time) are fully adjustable, the invention applies to any recirculating system.

As any amount of recirculation requires heat energy, the desire is to reduce recirculation to a minimum but still have instantaneous hot water available at the outlets for immediate use.

Comparisons can be made to other types of controls used on other hot water recirculating systems:

1. Heat sensing thermostats have been used to sense the water temperature in the return pipe and to control the turning on and off of the circulating pump motor in accordance with the temperature sensed in the return pipe. While this reduces the cost of recirculation somewhat, the inherent nature of such systems is that the temperature of the water in the pipes is still maintained at a fairly high level. The entire pipe loop is being regulated by the temperature of the water at the downstream end of the return pipe. Recirculation cost being the amount of heat energy lost by radiation through the pipe loop as the water travels through it, monitoring the temperature of the water at the end of the pipe loop and controlling the circulating pump from that temperature will not create a particularly significant reduction in water energy. Such a system is disclosed in the prior art patent to Laube et al., U.S. Pat. No. 3,383,495 issued May 14, 1968. Field testing of heat sensing thermostats shows that circulating time increases as the system size increases, resulting in more heat energy wasted. The following test report shows the comparison to the present invention.

PULSAR (the present invention) v. AQUASTAT (prior art)

Test Sight:

Willowbrook Apartments, Indianapolis, Ind.

42 units; 30 with 8 apartments, 2 story and 12 with 12 apartments, 3 story

Circulating System Data: All buildings are identical a. 1¼" supply, ¾" return, 1/12 HP circulating pump at 5 gpm uninsulated.

b. emersion type aquastat in return pipe c. gas fired heater set 130° F.

d. cost per Therm=$0.55

Method Of Test:

a. elapsed timers were installed on the pump motors in each type of building to record actual run time of the pump b. PULSAR was installed in parallel with the aquastat.

c. run time was recorded each day 1. one day PULSAR controlled 2. one day Aquastat controlled Test Data:

| Type Of Building | Aquastat Set Temp | Run Time Per Day | Temp Difference | BTU Load Per Day |
|---|---|---|---|---|
| 8 unit | 110° F. | 136.4 | 20° | 113,500 |
| 12 unit | 110° F. | 175.1 | 20° | 145,500 |
| 12 unit | 100° F.* | 127.1 | 30° | 158,250 |
| 8 unit | Pulsar: | 8.0 | 40° | 13,500 |
| 12 unit | 20 Sec Pulse 59 Min Pause | 8.0 | 40° | 13,500 |

Heat Energy Cost Of Recirculation ($.55 Therm):

8 unit building/Aquastat, set 110° F., 113,500 BTU/day=$253/year 12 unit building/Aquastat, set 110° F., 145,500 BTU/day=$324/year 8 or 12 unit building/PULSAR, set 110° F., 13,500 BTU/day=$29year Comparison: PULSAR vs Aquastat

*a. recirculation costs will increase with the size of the system b. decreased temperature settings will increase BTU load because of temperature difference PULSAR controlled:

a. saved $224/year in 8 unit buildings b. saved $295/year in 12 unit buildings

2. Demand type controllers, which are activated by flow or pressure, do not produce the energy savings that is available with the invention. Each of these controllers will operate the pump every time a hot water outlet is opened. If there were 100 separate demands per day, the recirculating pump will operate 100 times. The invention controlled pump will operate about 24 times per day, or once per hour. As the reheat load in BTU/hr is dependent upon time of recirculation, the control system with the lowest operating time will produce the largest energy savings. In addition, these type controllers do not offer instantaneous hot water at the outlets. The farther the outlet is from the storage tank, the longer the wait for hot water. Prior art U.S. Pat. No. 4,142,515 is illustrative of this.

3. A demand type control such as Stevenson U.S. Pat. No. 4,201,518 is a system whereby the user manually turns on the pump with a mechanical switch located at every service outlet that turns on the pump for a predetermined time period. It also incorporates a thermostatic overide to disable the pump when the temperature of the circulation loop has reached a predetermined temperature. This system is basically the systems described in comparisons 1 and 2 used together. Such a system as described while reducing the cost of circulation during evening periods, where there would be little demand for hot water, will not significantly offer a greater savings than a system using a thermostatically controlled circulating pump as outlined in comparison 1. It is also a disadvantage of the Stevenson system that while offering savings over a system using continuous circulation, the installation of this system in a large motel or apartment building would not be cost efficient due to the extensive network of switches and wiring that would have to be installed next to every service outlet and the possible confusion by the layman user on how the system operates. It is also a disadvantage of the Stevenson system that since it is basically a demand system that it can not offer instantaneous hot water at all service outlets all the time.

Reference Notes

Ref. No.

1. The coefficient constant 500 is the water factor having units of min.×BTU/hr.×gal. water °F.; and it converts the water gallonage per minute and the °F. temperature difference to BTU/hr. It is simply the product of factors, i.e., $$\frac{60\text{ min.}}{1\text{ hr.}} \times \frac{8.34\text{ lb. water}}{1\text{ gal.}} \times \frac{1\text{ BTU}}{1\text{ lb. water} \times 1^\circ\text{ F.}} = 500\,\frac{\text{Min. BTU}}{\text{hr. gal. }^\circ\text{F.}}$$

2. The number 3413 is the factor for convering BTU to KWH, as shown in Table 3 of *ASHRAE Equipment Handbook,* Ch. 46, p. 3 (ASHRAE, Inc., 345 E. 47th St., New York, NY 10017, 1975); also it is shown in *Handbook of Mathematical Tables and Formulas,* Burlington, p. 282 (Handbook Publishers, Inc., Sandusky, OH, 1957.
3. ASHRAE 1977 Fundamentals Handbook, Chapter 37, page 2, Table 2 (ASHRAE, Inc., 345 E. 47th St., New York, NY 10017, 1977)
4. ASHRAE 1977 Fundamentals Handbook, Chapter 37, page 3, Table 3, Ibid.
5. *Elements of Heat Transfer,* 3rd Edition, Max Jakob, George Hawkins Pg. 239 (John Wiley & Sons, NY) Chapman & Lall, London 3/1959
6. ASHRAE 1975 Equipment Handbook (See Ref. No. 2) Chapter 33, Page 6, Table 5, as copied herein.
7. *Elements of Heat Transfer and Insulation* (2nd Edition)—Max Jakob and George Hawkins (John Wiley & Sons, New York) Chapter 11-5, Pg. 173–1952
8. Ibid., Chapter 11, Pg. 174, Table 11-2
9. *Elements of Heat Transfer,* 3rd Edition, Page 134 (See Ref. No. 5)
10. ASHRAE 1976 Systems Handbook Chapter 15, Page 15, Table 1 (ASHRAE, Inc., 345 E. 47th St., New York, NY 10017, 1976)

It is thus seen that a control means and process, according to the inventive concepts, provides a desired and advantageous installation yielding the advantages of a control of the time of pump-running to achieve great economy of the water heating, in a recirculating domestic system, particularly advantageous in commercial buildings, yet providing the delivery of "instant" hot water at service outlets throughout the system.

Accordingly, it will thus be seen from the foregoing description of the invention according to this illustrative embodiment, considered with the accompanying drawings, that the present invention provides new and useful concepts in combination, which provide and achieve a novel and advantageous control means and process for achieving that great economy and energy-savings while nevertheless providing abundant and "instant" hot water at all the service outlets, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. An electrically controlled hot water recirculating system comprising a piped pressurized cold water supply flowing in a cold water supply pipe having a service valve, a check valve, and a 3-way pipe connection, to a hot water heating and storage device, the heated water from said heating and storage device flowing to a service shut-off valve, and then through a hot water supply pipe having branches leading to one or more service outlet(s) and then to a pipe or tube return line which continues the flow of water unused by any of the service outlets, through a return system comprising a service shut-off valve, an electric motor driven circulating pump for pumping the water, a check valve, a service valve, and the 3-way pipe connection located on the cold water supply pipe, and thus back to the cold water supply pipe, an adjustable electrical device for controlling the electric motor of the circulating pump and operative to control the amount of time the motor is running and the amount of time the motor is not running, the adjustable electrical device providing the operativity as follows:

(a) wherein the amount of time of the motor not running, and the pump not then pumping, being controlled by a user, depending, on the amount of time required for the water in the hot water supply pipe to cool from a desired high temperature to a desired low temperature, which depends upon the size and type of the hot water supply pipe, the length thereof, and the termperture difference between the water in the hot water supply pipe and the ambient temperature outside the hot water supply pipe, (b) and the amount of time of the motor running, and the pump pumping, being controlled by the user, depending on the time required to pump a volume of water equal to the volume of water in that portion of the hot water system from an outlet of the hot water device to the most downstream branch leading to a service outlet, which is dependent upon the pumping rate of the pump versus the volume of water in said hot water supply pipe thus determining the necessary amount of time of the pump operation without sensing the water temperature or pressure, and (c) the respective times of the motor not running and the pump not pumping, and the motor running and the pump pumping, being fixed and automatically repetitive regardless of the usage of hot water being dispensed through the service outlets.

* * * * *